US005147733A

United States Patent [19]

Werquin et al.

[11] Patent Number: 5,147,733

[45] Date of Patent: Sep. 15, 1992

[54] METHOD OF ROLLING METAL IN A FOUR-HIGH OR SIX-HIGH ROLL STAND IN A HOT CONTINUOUS ROLLING MILL TRAIN WITH A COMPOSITE BIMETALLIC SUPPORT ROLL

[75] Inventors: Jean-Claude Werquin, Ronchin; Jacques Bocquet, Maubeuge, both of France

[73] Assignee: Chavanne-Ketin Institut de Recherches de la Siderugie Francaise, Puteaux, France

[21] Appl. No.: 706,418

[22] Filed: May 28, 1991

Related U.S. Application Data

[62] Division of Ser. No. 415,302, filed as PCT/FR88/00624, Dec. 19, 1988, abandoned.

[30] Foreign Application Priority Data

Dec. 23, 1987 [FR] France ..... 87 18069

[51] Int. Cl.[5] ..... B32B 15/00

[52] U.S. Cl. ..... 428/683; 428/684; 428/685

[58] Field of Search ..... 428/684, 685, 683; 29/130, 132; 148/325

[56] References Cited

FOREIGN PATENT DOCUMENTS

| | | | |
|---|---|---|---|
| 53-106333 | 9/1978 | Japan | 29/132 |
| 59-76696 | 5/1984 | Japan | 29/132 |
| 328195 | 3/1972 | U.S.S.R. | 148/325 |

*Primary Examiner*—Deborah Yee
*Attorney, Agent, or Firm*—Cushman, Darby & Cushman

[57] ABSTRACT

A bimetallic composite back-up cylinder for a rolling mill, in particular for a four-coil or six-roll stand of a hot strip train finisher, comprises a metal envelope made of a steel having a chromium content between 13 and 17 wt. %, and a carbon content between 0.5 and 0.8 wt. % the chromium/carbon ratio being between 20 and 25.

5 Claims, No Drawings

METHOD OF ROLLING METAL IN A FOUR-HIGH OR SIX-HIGH ROLL STAND IN A HOT CONTINUOUS ROLLING MILL TRAIN WITH A COMPOSITE BIMETALLIC SUPPORT ROLL

This is a division of application Ser. No. 07/415,302, filed as PCT/FR88/00624, Dec. 19, 1988, now abandoned.

The subject of the present invention is a composite bimetallic support roll for a rolling mill and concerns more particularly a support roll for a four-high or six-high roll stand of a finisher of a hot continuous rolling mill train.

Support rolls generally used in these finishing stands are traditionally made by moulding or forging, and their hardness, when measured using the Shore process, is between 50 and 70 shC.

The contents of the various elements which are included in the composition of the outer metal layer of steel of these rolls are contained within the following limits:

| C | Si | Mn | S | P | Cr | Ni | Mo |
|---|---|---|---|---|---|---|---|
| 0.5 | 0.3 | 0.7 | 0 | 0 | 1.5 | 0.5 | 0.3 |
| 1 | 0.7 | 1.8 | 0.015 | 0.015 | 5 | 2 | 0.5 |

the percentages being expressed by weight.

In order to obtain great hardnesses, the support rolls can be made of forged steel with differential quenching, or of compound steel (bimetallic), these two techniques enabling useful working thicknesses to be obtained, which can reach 100 mm in radius.

These support rolls are submitted to very great forces due to the laminating forces which are applied to them and which can in addition be heavily increased in the case of laminating accidents.

Also, in order to obtain a good flatness of the finished products, the rolls must be very rigid. With this aim, the core of the support rolls is always made of steel and consequently has a very high Young's modulus.

In spite of the efforts carried out aiming at constant improvement of the strength of the support rolls, and aiming in particular at increasing their resistance to wear, it is noted that the rolls, and in particular those of the last finishing stands (stands F5 to F7) continue to wear quickly. This wear causes the formation of a hollow in the central part of the roll at a rate which can reach 0.3 mm radially per 100,000 tons of products. Consequently the creation of wide products having excellent flatness characteristics can only be ensured at the beginning of a laminating session, that is in the period during which the central hollow is still slight. This obligation is especially annoying because it opposes the general tendency aiming at allowing free scheduling of the use of continuous rolling mill trains ("Schedule Free Rolling").

In an initial attempt aiming to solve this problem, it was proposed to use support rolls made of cast-iron with a high chromium content. These initial tests, carried out on several rolling mills, all ended in failures. In effect, in spite of their high degree of hardness of between 70 and 75 ShC and their high content of hard carbides, the wear of this type of roll was shown to be greater, sometimes reaching double that of traditional rolls.

This phenomenon of excessive wear could result from the acceleration phenomenon which the finisher undergoes after engagement of the band in the coiler, thus causing excessive slipping due to the change in the friction coefficient, the latter being lower in the presence of chromium carbides.

Furthermore, the environment of the support rolls, which are permanently sprayed with the cooling water of the rolling mill, is polluted by numerous abrasive particles resulting from the wear of the rolls and the scale of the band, and tends to cause a great deal of corrosion.

Examination of the surfaces of the support rolls made of cast-iron with a high chromium content, and in particular in the final stands, reveals breaking down of the carbides. However, it can be clearly seen that the broken down carbides are surrounded by a border of oxide. It is well known that the zone of matrix/carbide interface is a favoured zone for the phenomenon of oxidation, but it has been shown in the laboratory, working with the same material, that corrosion by the cooling water is capable, on its own, of causing the breaking down of the chromium carbides by a sort of wedge action.

It has also been shown that the improvement of the resistance to wear of the support rolls cannot be brought about by increase of the carbide phase. Nevertheless, the main phenomenon which influences the wear of the support roll seems to be the corrosion by the cooling water.

The object of the present invention, therefore, is to propose a roll of which the resistance to corrosion is increased significantly, whilst retaining the other properties of the support rolls, namely in particular a very good resistance to rolling fatigue, and a very good rigidity resulting from the presence of a steel core.

With this aim, the invention concerns a composite bimetallic support roll for a rolling mill, in particular for four-high or six-high roll stands of a finisher of a hot continuous rolling mill train, characterized in that it includes a metal envelope made of steel having a chromium content of between 13 and 17%, and a carbon content of between 0.5 and 0.8% by weight, the chromium/carbon ratio being between 20 and 25.

Due to this composition, a metal envelope is made of steel with a very high chromium content, resistant to corrosion and to rolling fatigue.

The carbon content is limited to 0.8% in order to avoid an excessive carbide phase.

The minimum carbon content of 0.5% enables a sufficient hardness to be obtained, through quenching, of about 70 ShC.

According to another characteristic of the invention, the support roll contains a metal core constituted by unalloyed low-carbon steel which has a carbon content of between 0.3 and 0.6% by weight.

Other elements are added to the metal envelope to obtain, by simple air quenching, a hardness of between 70 and 75 ShC.

According to the invention the steel which makes up the metal envelope has a nickel content of between 1 and 2.5% by weight, which enables the formation of delta ferrite to be avoided while increasing the gamma domain.

One of the main difficulties for the creation of such a metal support roll is obtaining a bond zone between the envelope metal and the core metal which does not contain small shrinkage cavities such as those usually found in support rolls obtained by static compound casting.

In effect, for hardness values of between 70 and 75 ShC, and because of the weaker coefficient of expansion of the envelope metal in relation to the core metal, the inner tensions of such a support roll are very high and the small shrinkage cavities, of which the edges are always pointed, serve as the focal point for the progression of scaling, developing concentrically, caused mainly by the internal force of radial traction which alternates with the internal force of radial compression due to the forces of lamination.

In order to remedy these inconveniences, the invention proposes a support roll characterized in that it is made according to the technique of vertical axis centrifugal casting.

The following example can be put forward for the creation of a support roll, for hot continuous rolling mill trains, with a diameter of 1335 mm and a length of 1695 mm:

a) surrounding metal:

C=0.63; Si=1.22; Mn=0.67; S=0.012; P=0.018; Cr=13.23; Ni=0.72; Mo=1.05; and V=0.17 (% by weight).

b) core metal:

C=0.52; Si=0.63; Mn=0.62; S=0.019; P=0.023; Cr=0.22; and Ni=0.53 (% by weight).

After austenitation at 950° C. and air quenching followed by two temperings at 510° C., a hardness is obtained of between 72 and 75 ShC.

Such a roll was used in all the stands of a finisher and the wear in stands F5 and F6 was significantly reduced in relation to the traditional solution of compound steel of a hardness of between 60 and 65 ShC and a chromium content of 1.8% by weight.

We claim:

1. A method of rolling metal in a four-high or six-high roll stand in a hot continuous rolling mill train with a composite bimetallic support roll, wherein the support roll comprises an envelope metal of steel with a chromium content of between 13 and 17% by weight, and a carbon content of between 0.5 and 0.8% by weight, the chromium/carbon ratio being between 20 and 25.

2. A method of rolling metal according to claim 1, wherein a core metal of said support roll is comprised of an unalloyed steel having a carbon content of between 0.3 and 0.6% by weight.

3. A method of rolling metal according to claim 1 or 2, wherein said envelope metal of said support roll is comprised of a nickel content of between 1 and 2.5% by weight.

4. A method of rolling metal according to any one of claims 1 to 3, wherein said support roll is made according to the technique of vertical axis centrifugal casting.

5. A method of rolling metal according to claim 3, wherein said support roll is made according to the technique of vertical axis centrifugal casting.

* * * * *